US008650794B2

(12) United States Patent
Swan et al.

(10) Patent No.: US 8,650,794 B2
(45) Date of Patent: Feb. 18, 2014

(54) FIREARM FASTENER

(75) Inventors: Johnny E. Swan, Virginia Beach, VA (US); Peter Everett Kent, Virginia Beach, VA (US); Andrew C. Borland, Virginia Beach, VA (US)

(73) Assignee: S&S Precision, LLC, Virginia Beach, VA (US)

( * ) Notice: Subject to any disclaimer, the term of this patent is extended or adjusted under 35 U.S.C. 154(b) by 54 days.

(21) Appl. No.: 13/135,032

(22) Filed: Jun. 23, 2011

(65) Prior Publication Data

US 2012/0030986 A1 Feb. 9, 2012

Related U.S. Application Data

(63) Continuation-in-part of application No. 12/386,539, filed on Apr. 20, 2009, now Pat. No. 8,166,694.

(60) Provisional application No. 61/124,705, filed on Apr. 18, 2008.

(51) Int. Cl.
*F41C 33/04* (2006.01)

(52) U.S. Cl.
USPC ..... 42/90; 42/85; 42/106

(58) Field of Classification Search
USPC ..... 42/85, 90, 106; 24/3.1, 3.11, 3.12; 224/191, 913
See application file for complete search history.

(56) References Cited

U.S. PATENT DOCUMENTS 1,107,040 A 8/1914 Conde
1,610,092 A 10/1924 Hise
1,613,203 A 1/1927 Shannon
1,946,059 A 2/1934 Buchholz et al.
2,236,736 A 9/1938 Scott
2,296,287 A 9/1942 Leyde
2,346,695 A 4/1944 Miller
2,545,419 A 3/1951 Williams
2,837,630 A 6/1958 Shen
2,972,739 A 2/1961 Opper
3,155,297 A 11/1964 Stumpf
3,348,746 A 10/1967 Stumpf
3,769,663 A 11/1973 Perl
3,834,052 A 9/1974 Steck, III
3,908,950 A 9/1975 Apel
4,008,536 A 2/1977 Adams
4,216,600 A 8/1980 Brueckner et al.
4,462,064 A 7/1984 Schweitzer
4,504,001 A 3/1985 Nichols
4,639,944 A 2/1987 Lashley et al.
4,750,656 A 6/1988 Bianchi et al.
4,777,754 A 10/1988 Reynolds, Jr.

(Continued)

OTHER PUBLICATIONS

Design U.S. Appl. No. 29/395,765, Plate Carrier Vest, filed Mar. 27, 2012, Johnny E. Swan and Andrew C. Borland.

(Continued)

*Primary Examiner* — Michael David
(74) *Attorney, Agent, or Firm* — Speed Law Firm

(57) ABSTRACT

Embodiments include a method and apparatus for removably connecting a firearm, accessory, or tool to a surface, material, object, belt, vehicle, pocket, or tactical equipment. The apparatus may include a first connecting member operatively connectible to the firearm, accessory, or tool and a second connecting member operatively connectible to the surface, material, object, belt, vehicle, pocket, or tactical equipment. The first connecting member and second connecting member are capable of connection to one another to connect the firearm, accessory, or tool to the surface, material, object, belt, vehicle, pocket, or tactical equipment.

20 Claims, 10 Drawing Sheets

(56) References Cited

U.S. PATENT DOCUMENTS

| | | | |
|---|---|---|---|
| 4,797,793 | A | 1/1989 | Fields |
| 4,905,396 | A | 3/1990 | Bechtel |
| 4,939,863 | A | 7/1990 | Alexander et al. |
| 5,014,892 | A | 5/1991 | Copeland |
| 5,018,653 | A | 5/1991 | Shoemaker |
| 5,033,219 | A | 7/1991 | Johnson et al. |
| 5,040,322 | A | 8/1991 | Iturrey, Jr. |
| 5,054,170 | A | 10/1991 | Otrusina |
| 5,070,437 | A | 12/1991 | Roberts, Sr. |
| 5,122,781 | A | 6/1992 | Saubolle |
| 5,165,782 | A | 11/1992 | Maglica et al. |
| D332,172 | S | 1/1993 | Lewis |
| 5,203,624 | A | 4/1993 | Schier et al. |
| D340,542 | S | 10/1993 | Marlowe |
| 5,265,781 | A | 11/1993 | Nichols |
| 5,267,131 | A | 11/1993 | Anthony et al. |
| D352,165 | S | 11/1994 | Covertson |
| 5,400,008 | A | 3/1995 | Toohey |
| 5,414,405 | A | 5/1995 | Hogg et al. |
| 5,430,967 | A | 7/1995 | Woodman, III et al. |
| 5,436,814 | A | 7/1995 | Hanley |
| 5,438,494 | A | 8/1995 | Harlan |
| 5,469,346 | A | 11/1995 | Haut et al. |
| 5,564,610 | A | 10/1996 | Barron |
| 5,598,958 | A | 2/1997 | Ryan et al. |
| 5,620,120 | A | 4/1997 | Tien |
| 5,622,297 | A | 4/1997 | Rogers et al. |
| 5,633,623 | A | 5/1997 | Campman |
| 5,639,005 | A | 6/1997 | Chouinard |
| 5,644,792 | A | 7/1997 | Tishler et al. |
| 5,671,561 | A | 9/1997 | Johnson et al. |
| 5,697,695 | A | 12/1997 | Lin et al. |
| 5,716,121 | A | 2/1998 | Dubois |
| 5,735,594 | A | 4/1998 | Own |
| 5,771,489 | A | 6/1998 | Snedeker |
| 5,810,221 | A | 9/1998 | Beletsky et al. |
| 5,839,630 | A | 11/1998 | Dunstan et al. |
| 5,850,954 | A | 12/1998 | Dong-Joo |
| 5,865,524 | A | 2/1999 | Campman |
| 5,978,961 | A | 11/1999 | Barker |
| 5,996,115 | A | 12/1999 | Mazelsky |
| 6,012,827 | A | 1/2000 | Caplan et al. |
| 6,059,156 | A | 5/2000 | Lehtinen |
| 6,067,013 | A | 5/2000 | Pejic |
| 6,069,557 | A | 5/2000 | Anglin, Jr. et al. |
| 6,112,448 | A | 9/2000 | Gray et al. |
| 6,148,447 | A | 11/2000 | Bain et al. |
| 6,158,874 | A | 12/2000 | Brustein et al. |
| 6,161,741 | A | 12/2000 | French |
| 6,175,958 | B1 | 1/2001 | Wu |
| 6,185,854 | B1 | 2/2001 | Solinsky et al. |
| 6,190,018 | B1 | 2/2001 | Parsons et al. |
| 6,190,025 | B1 | 2/2001 | Solinsky |
| 6,213,623 | B1 | 4/2001 | Campman |
| 6,276,088 | B1 | 8/2001 | Matthews et al. |
| D452,047 | S | 12/2001 | Ditchfield et al. |
| 6,371,625 | B2 | 4/2002 | Campman |
| 6,393,752 | B1 | 5/2002 | Oliver et al. |
| 6,478,441 | B2 | 11/2002 | Lam |
| 6,499,245 | B1 | 12/2002 | Swan |
| 6,578,311 | B2 | 6/2003 | Danielson et al. |
| 6,616,294 | B1 | 9/2003 | Henry |
| 6,685,067 | B2 | 2/2004 | French |
| 6,722,771 | B1 | 4/2004 | Stephens |
| 6,742,913 | B2 | 6/2004 | Deutsch |
| 6,785,997 | B2 | 9/2004 | Oz |
| 6,793,366 | B2 | 9/2004 | Chun |
| 6,817,727 | B1 | 11/2004 | McFadden |
| 6,910,224 | B2 | 6/2005 | Ikenaga et al. |
| 6,955,279 | B1 | 10/2005 | Mudd et al. |
| 6,976,777 | B1 | 12/2005 | Herold |
| 7,021,790 | B2 | 4/2006 | Parsons |
| 7,096,620 | B2 | 8/2006 | Zeh |
| 7,156,536 | B1 | 1/2007 | McCorkle |
| 7,195,370 | B2 | 3/2007 | Riblett et al. |
| 7,218,142 | B2 | 5/2007 | Nozawa et al. |
| 7,218,241 | B2 | 5/2007 | Kessel et al. |
| 7,226,183 | B2 | 6/2007 | Galli et al. |
| 7,267,453 | B2 | 9/2007 | Chang et al. |
| 7,287,873 | B2 | 10/2007 | Galli |
| 7,290,896 | B2 | 11/2007 | Dallas et al. |
| 7,293,893 | B2 | 11/2007 | Kim |
| 7,395,627 | B2 | 7/2008 | La France et al. |
| 7,434,955 | B2 | 10/2008 | Vickers et al. |
| 7,444,776 | B2 | 11/2008 | Adams |
| 7,458,489 | B1 | 12/2008 | Mudd et al. |
| 7,510,294 | B2 | 3/2009 | Steele et al. |
| 7,517,108 | B2 | 4/2009 | Galli et al. |
| 7,523,583 | B2 | 4/2009 | Cheng |
| 7,534,006 | B2 | 5/2009 | Goswami et al. |
| 7,562,484 | B2 | 7/2009 | Kim |
| 7,682,037 | B1 | 3/2010 | Hose et al. |
| 7,694,450 | B2 | 4/2010 | Keng |
| 7,712,148 | B2 | 5/2010 | Carlson |
| 7,731,385 | B2 | 6/2010 | Spartano et al. |
| 7,735,255 | B1 | 6/2010 | Kincaid et al. |
| 7,736,013 | B2 | 6/2010 | Griffin |
| 7,743,547 | B2 | 6/2010 | Houde-Walter |
| D622,036 | S | 8/2010 | Mason, III |
| 7,827,724 | B1 | 11/2010 | Spinelli |
| 7,836,625 | B2 | 11/2010 | Swan et al. |
| 7,896,518 | B2 | 3/2011 | Holmes et al. |
| D640,417 | S | 6/2011 | Haynes |
| D641,960 | S | 7/2011 | Goff et al. |
| D648,489 | S | 11/2011 | Stockard |
| D652,573 | S | 1/2012 | Rodriguez |
| 8,166,694 | B2 | 5/2012 | Swan |
| D666,363 | S | 8/2012 | Culbertson |
| 8,256,020 | B2 | 9/2012 | Dovner et al. |
| 2002/0096545 | A1 | 7/2002 | Chang |
| 2002/0148865 | A1 | 10/2002 | French |
| 2003/0090893 | A1 | 5/2003 | Nepil |
| 2003/0098323 | A1 | 5/2003 | Taylor et al. |
| 2003/0123254 | A1 | 7/2003 | Brass et al. |
| 2003/0141329 | A1 | 7/2003 | Huang |
| 2004/0000083 | A1 | 1/2004 | Grant, Jr. |
| 2004/0069821 | A1 | 4/2004 | Kobayashi |
| 2004/0145889 | A1 | 7/2004 | Hendricks |
| 2005/0010987 | A1 | 1/2005 | Crye et al. |
| 2005/0180130 | A1 | 8/2005 | Harris et al. |
| 2006/0026888 | A1 | 2/2006 | Cheng et al. |
| 2006/0198132 | A1 | 9/2006 | Trigiani et al. |
| 2006/0236583 | A1 | 10/2006 | Pikielny |
| 2006/0253950 | A1 | 11/2006 | Kerr |
| 2007/0079415 | A1 | 4/2007 | Carlson |
| 2007/0230162 | A1 | 10/2007 | Galli et al. |
| 2008/0205037 | A1 | 8/2008 | Griffin |
| 2008/0235841 | A1 | 10/2008 | McDunn et al. |
| 2009/0122527 | A1 | 5/2009 | Galli |
| 2009/0151036 | A1 | 6/2009 | Joseph |
| 2009/0185854 | A1 | 7/2009 | Adams |
| 2009/0190332 | A1 | 7/2009 | Sharrah |
| 2009/0293334 | A1 | 12/2009 | Swan |
| 2010/0018103 | A1 | 1/2010 | Holmberg |
| 2010/0128470 | A1 | 5/2010 | Swan et al. |
| 2010/0192448 | A1 | 8/2010 | Darian |
| 2010/0229450 | A1 | 9/2010 | Becker et al. |
| 2011/0032694 | A1 | 2/2011 | Swan |
| 2011/0131694 | A1 | 6/2011 | Fearon |
| 2011/0209260 | A1 | 9/2011 | Herbener et al. |
| 2011/0231985 | A1 | 9/2011 | Bishop |
| 2011/0249432 | A1 | 10/2011 | Swan et al. |
| 2012/0057360 | A1 | 3/2012 | Swan |

OTHER PUBLICATIONS

U.S. Appl. No. 13/506,182, Plate Carrier Apparatus and Method, filed Apr. 2, 2012, Johnny E. Swan and Andrew C. Borland.

FIREARM FASTENER

CROSS-REFERENCE TO RELATED APPLICATIONS

This application is a continuation-in-part of U.S. patent application Ser. No. 12/386,539, filed Apr. 20, 2009, now U.S. Pat. No. 8,166,694 B2, which claims benefit of U.S. provisional patent application Ser. No. 61/124,705, filed Apr. 18, 2008. Each of the aforementioned related patent applications is herein incorporated by reference.

BACKGROUND OF THE INVENTION

1. Field of the Invention

Embodiments generally relate to the attachment of accessories to military and law enforcement tactical equipment, belts, vehicles, or other objects, surfaces, or materials. More particularly, some embodiments relate to the attachment or optional mounting of firearms or assault rifles onto tactical equipment, belts, vehicles, or other objects.

2. Description of the Related Art

During military and law enforcement operations, individuals must routinely conduct activities without anything in their hands (hands-free activity). These potentially dangerous operations would typically require the individual (e.g., a soldier or police officer) to carry a firearm such as a rifle-type firearm for personal protection, which most likely would require a sling system in order to retain the rifle on the individual.

Modern-day slings come in a variety of shapes and sizes. For this discussion, we will focus on a single point sling 990, such as is shown in FIG. 21. A single point sling 990 is a simple continuous loop of flat fiber strapping or webbing material made of nylon or cotton with a single metal fastener that connects to a rifle 4 at a single point 995, hence its being referred to as a "single" point sling 990. This single point sling 990 is typically worn over the upper torso of an individual's body 996 in order to retain the rifle 4 thereon. While the rifle 4 may be connected to the upper torso, it is far from being securely held onto the body 996; rather, the rifle 4 may loosely spin, twist or fly around during vigorous activities such as climbing, fast roping, or detaining a suspect. Not only is the loose rifle a hazard to the individual but also to the individual's team members, equipment and suspects during detaining.

Therefore, there is a need to correct this potential hazard with a higher level of weapon retention via a weapon retention device. A weapon retention device is also needed which is lightweight and is a low profile projection from the rifle or other firearm.

Thus, the current popular method for attachment of an assault rifle 4 onto tactical equipment is the use of nylon webbing as a sling (e.g., sling 990 shown in FIG. 21). The sling 990 is configured in such a manner that it creates a loop of webbing from the rifle 4 at one point, such as the point shown in FIG. 21 referred to as the around the individual 996 and back to the rifle 4 at the same point or other point depending on individual preference.

As the sling is a simple loop of material around the individual, it provides no real retention of the rifle during other activities that require the rifle to be out of the way and secure. When the weight of the rifle is solely loaded on the sling without the individual touching the rifle, the rifle is referred to as "slung". When the rifle is slung to the front position, side position, or the back of the body, it is not held in position by anything other than gravity tension on the sling and the lack of movement by the individual. If the individual were to climb, walk, run, bend over, or fall down, the rifle would move out of its intended position. Therefore, there exists a need to facilitate a convenient and secure attachment and detachment method of the rifle or other firearm and/or one or more accessories to tactical equipment, belts, vehicles, or other objects.

SUMMARY OF THE INVENTION

To this end, embodiments advantageously include a device or apparatus which provides for secure, convenient, fast, and easy attachment and/or detachment of a firearm, tool, and/or accessory to/from tactical equipment, objects, surfaces, or materials.

Embodiments may further include the option of one-handed attachment and/or detachment of the firearm, tool, and/or accessory to/from tactical equipment, objects, surfaces, or materials.

Embodiments may advantageously provide attachment a weapon retention device or firearm fastener with positional security.

Embodiments may provide a weapon retention device which is lightweight and is a low profile projection from the rifle or other firearm.

Embodiments generally include an apparatus for connecting a firearm to tactical equipment or a material or object, comprising a first connecting member operatively and fixedly attachable to the firearm; a second connecting member operatively and fixedly attachable to the tactical equipment or material or object, wherein the first connecting member and second connecting member are removably attachable to one another to connect the firearm to the tactical equipment or material or object. Embodiments may also include an apparatus for connecting a firearm to tactical equipment, a surface, or an object, comprising a clasping portion capable of fixing the apparatus horizontally to the firearm or a rail section attachable to the firearm or another object; a connector capable of fixing the apparatus vertically to the firearm or a rail section attachable to the firearm or another object; and a clipping portion capable of clipping the tactical equipment, surface, or object to the firearm, rail section, or other object.

Other embodiments may include a method of connecting a firearm to tactical equipment, comprising providing an apparatus having a first connecting member and a second connecting member; operatively connecting the first connecting member to a firearm or accessory, wherein the first connecting member is fixed in position along a length and width of the firearm or accessory; operatively connecting the second connecting member to tactical equipment or a surface or material, wherein the second connecting member is fixed in position along a length and width of the firearm or accessory; and connecting the first connecting member and second connecting member to one another, wherein the first connecting member and second connecting member are attachable and detachable from one another using one hand, wherein the first connecting member is operatively connected to the firearm or accessory using a clasping member to fix a width of the first connecting member and at least one first fastening member to fix a length of the first connecting member relative to the firearm or accessory; the second connecting member is operatively connected to the tactical equipment or surface or material using at least one second fastening member; and the first and second connecting member are connected to one another when a protruding mechanism in one of the connecting members cooperates with a slot in the other connecting member.

Some embodiments generally include an apparatus for connecting a firearm to tactical equipment, comprising a grabbing portion capable of positionally fixing the apparatus with respect to a width of the firearm or a rail section attachable to the firearm or another object; a connector capable of positionally fixing the apparatus with respect to a length of the firearm or a rail section attachable to the firearm or another object; and a clipping portion capable of clipping the tactical equipment to the firearm, rail section, or other object.

Other embodiments generally include a method of connecting a firearm or accessory to tactical equipment or a receiving piece operatively connected to a user's body, comprising providing an apparatus having a first connecting member and a second connecting member, the second connecting member including a hooking member; operatively connecting the first and second connecting member to one another and to the firearm or accessory so that the first and second connecting member cooperate to fix the apparatus in position along a length and width of the firearm or accessory; and hooking the tactical equipment or receiving piece to the apparatus by inserting the tactical equipment or receiving piece within the hooking member.

Yet other embodiments generally include an apparatus for connecting a firearm to tactical equipment, comprising a rail grabber having a hooking member for receiving and tensioning a strapping member, the hooking member having an opening which is wide enough to receive a thickness of the strapping member and narrow enough to maintain surface tension along the strapping member surface, the rail grabber for grabbing a rail connectable to a firearm and positionally maintaining the apparatus with respect to the rail.

BRIEF DESCRIPTION OF THE DRAWINGS

So that the manner in which the above-recited features of embodiments can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
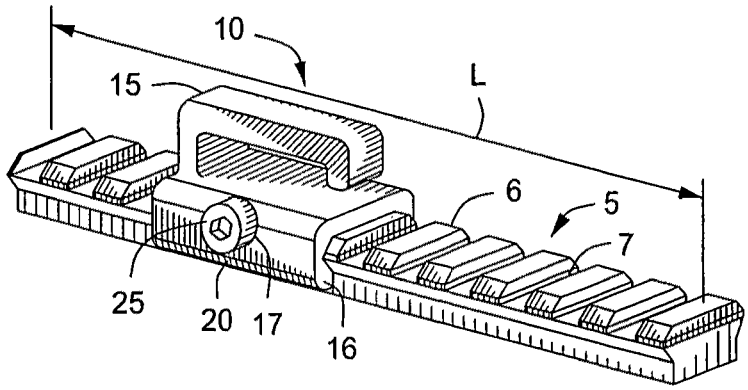
FIG. 1 is a side perspective view of a first embodiment of a WeaponLink™ apparatus operatively attached to a rail system.

Embodiments may include a platform herein referred to as a WeaponLink™ apparatus, for example as shown and described in FIGS. 1-20 and 22-25, which is capable of accepting one or more multiple optional accessories (i.e. one or more firearms, assault rifles, mechanical tools, quick detach pouches, etc.) from one surface of tactical equipment to another surface or piece of equipment at desired locations and with positional security. The WeaponLink™ apparatus may include slides, threaded holes, spindles, clips, spring loaded tension devices, and/or other mounting fixtures suitable for securing the one or more accessories to various surfaces or tactical equipment. The WeaponLink™ apparatus may be configured to present a relatively low-profile protrusion from tactical equipment using physical surfaces that offer low risk of snagging or becoming caught in external devices when accessories are not in place. Embodiments may allow for adjustment of the position of the accessories when they are attached to the WeaponLink™ apparatus, which desirably may accept more than one optional accessory. Advantageously, the WeaponLink™ apparatus permits the user to attach and/or detach the accessories to and/or from the tactical equipment surface or other surface using only one hand with positional security resulting upon attachment. Embodiments advantageously allow addition of the WeaponLink™ apparatus to already-manufactured rail systems, tactical equipment, and optional accessories.

Generally, the WeaponLink™ apparatus may employ one or more mechanisms that may grab and tension one or more surfaces of tactical equipment, e.g., the side and top surfaces of a standard M1913A rail system or any other rail or rail system known to those skilled in the art. In some embodiments, the WeaponLink™ apparatus accessory mount may be secured to the rail system using one or more existing through-holes with one or more threaded fasteners, rivets, nuts, bolts, and/or spring loaded balls or plunger type devices which may be made, for example, from plastic (for light duty applications), stainless steel, aluminum, and/or forge-hardened steel.

A benefit of embodiments is that the WeaponLink™ apparatus mount may be added to already-manufactured rail systems, tactical equipment, and/or optional accessories. If necessary, the female and male interface shape of the WeaponLink™ apparatus (which may, for example, be round), may be modified to a dovetail, square, or other shape to accommodate generally positive fixture stability depending on shape design and customer requirements.

The WeaponLink™ apparatus acts as a fastener of a firearm, tool, or other accessory to a user's belt, vehicle, tactical gear, or other object, material, or surface. In one embodiment, a first portion of the WeaponLink™ apparatus is attachable to the firearm, tool, or other accessory, and a second portion of the WeaponLink™ apparatus is attachable to the user's belt, vehicle, tactical gear, or other object, material, or surface. The first and second portions may be attachable to one another and removable from one another, e.g., by moving a protrusion through a slot or by screwing or unscrewing motion, and may be lockable into place with respect to one another when moved or screwed in relationship to one another. One of the portions of the firearm fastener WeaponLink™ apparatus may include a hole through which the other corresponding portion of the firearm fastener is moveable or screwable into the locked or unlocked position.

The WeaponLink™ apparatus may be used to provide firearm/weapon retention during hands-free operations, for example during military or law enforcement use.

In some embodiments, the WeaponLink™ apparatus (in some embodiments a SlingClip™) creates a secondary attachment point, which may be a temporary attachment point, for the single point sling to tighten the single point sling to the user's body. In this embodiment, the WeaponLink™ apparatus acts as a fulcrum or additional bend point in the flat woven strapping. By moving the WeaponLink™ apparatus further away from the sling's own single point attachment fastener, the sling becomes tighter against the user's upper torso. When the user routes the sling webbing material into the WeaponLink™ apparatus, it creates more tension and draws the rifle into a snug fit in the user's upper torso, thereby creating a much greater level of weapon/firearm retention.

Embodiments may also include using hooking action of the WeaponLink™ apparatus (in some embodiments a SlingClip™) to hang or hook a firearm onto a receiving piece which may be a temporary receiving piece (e.g., belt, pants pocket, tactical vest of the user). The weight of the firearm may be used as a downward force on the hook of the SlingClip™ and receiving material and provide a quick and temporary firearm retention method.

The WeaponLink™ apparatus may be used as a low profile device on a rail system, e.g., on the M1913 Picatinny Rail System. The WeaponLink™ apparatus or SlingClip™ may be easily added to existing or already-manufactured rail systems and tactical equipment.

A first embodiment of the WeaponLink™ apparatus 10 is shown in FIG. 1. In this embodiment, the WeaponLink™ apparatus 10 may be a clip device. Depicted in FIG. 1 is a rail section 5 to which the apparatus 10 may be attachable. The rail section 5 may have ridges or raised portions 6 with spaced slots or cutouts 7 therebetween. In one embodiment, the rail section 5 is a M1913A Picatinny rail section, although the rail section 5 may instead be any type of rail section known to those skilled in the art. The rail section 5 may be attached to a firearm such as an assault rifle. The rail section 5 or rail may be a bracket connectable to a firearm for providing a standardized platform for mounting accessories thereto.

The apparatus 10 may include a connecting portion 20 which may be shaped to removably connect to the rail section 5, for example generally U-shaped. The generally U-shaped portion 20 of the apparatus 10 may include inward protrusions 16 on each bottom side (which is the top of the "U") which secure the apparatus 10 around the rail section 5. The distance between inner surfaces of the inward protrusions 16 may be less than the distance between inner surfaces of a portion of the U-shaped portion 20 to allow clasping of the apparatus 10 onto the rail section 5 while at the same time permitting movement of the apparatus 10 along the length L of the rail section 5.

One or more holes 17 through the portion 20 may accommodate one or more fastening members 25, e.g., one or more screws, bolts, and/or nuts. The one or more fastening members 25 may positionally secure the apparatus 10 to the rail section 5 at a location along the length L of the rail section 5. For example, screwing or inserting the fastening member(s) 25 into the hole(s) 17 may lock the apparatus 10 to the rail section 5 at a position along the length L of the rail section 5 and unscrewing or removing the fastening member(s) 25 from the hole(s) 17 may unlock the apparatus 10 from the rail section 5 to allow movement of the apparatus 10 relative to the rail section 5 lengthwise or longitudinally. The one or more fastening members 25 may include one or more threaded fasteners, rivets, nuts, bolts, cam-type devices, and/or spring loaded balls or plunger-type devices. The one or more fastening members 25 may be made from plastic (e.g., for light duty applications), stainless steel, aluminum, and/or forge-hardened steel. Of course, any other type of fastening member known to those skilled in the art made of any material known to those skilled in the art for constructing fastening members may be utilized in combination with or in lieu of the above-listed examples.

The apparatus 10 may include a clip portion 15 which is either molded to or operatively connected to the U-shaped portion 20. The clip portion 15 may be a clip-like protrusion which extends longitudinally with respect to the U-shaped portion 20. The clip portion 15 is preferably made of a material which stays in the position shown in FIG. 1 until sufficient force to move the clip portion 15 relative to the U-shaped portion 20 is exerted by a material or object inserted between the clip portion 15 and the U-shaped portion 20. The material or object may be, for example, one or more locations along the MOLLE (modular lightweight load-carrying equipment) system of a standard military tactical vest (e.g., nylon vest), a belt (e.g., along the waistline), a pocket (either attached or unattached to clothing), or other tactical equipment.

Figure 2:
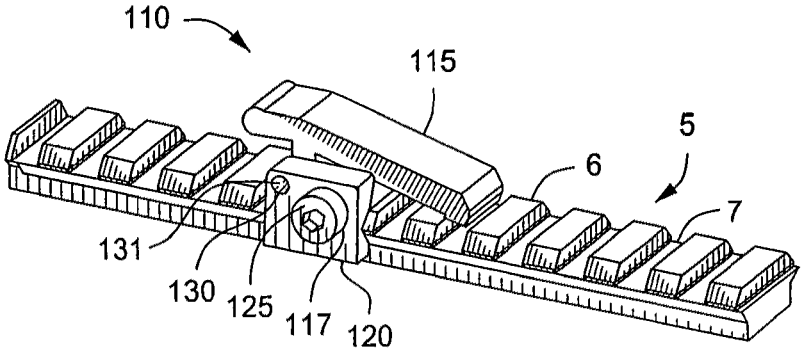
FIG. 2 is a side perspective view of a second embodiment of a WeaponLink™ apparatus operatively attached to a rail system.
Figure 3:
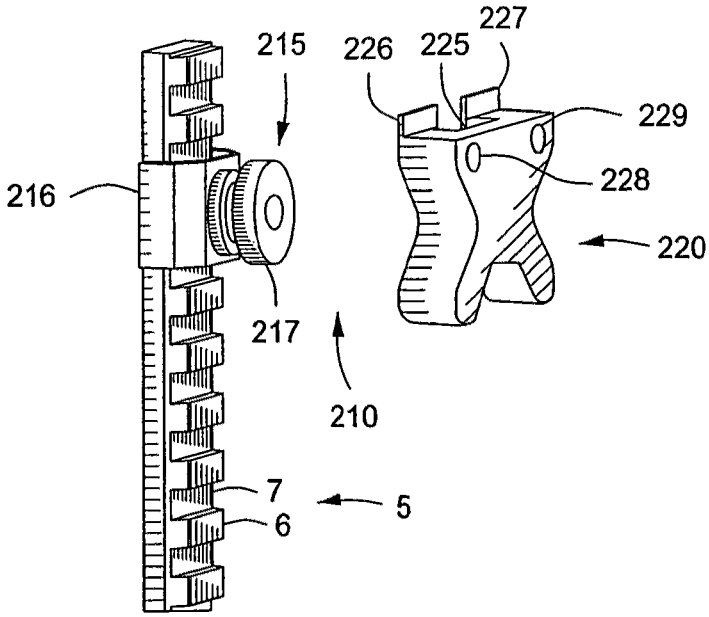
FIG. 3 is a side perspective view of a third embodiment of a WeaponLink™ apparatus operatively attached to a rail system.
Figure 4:
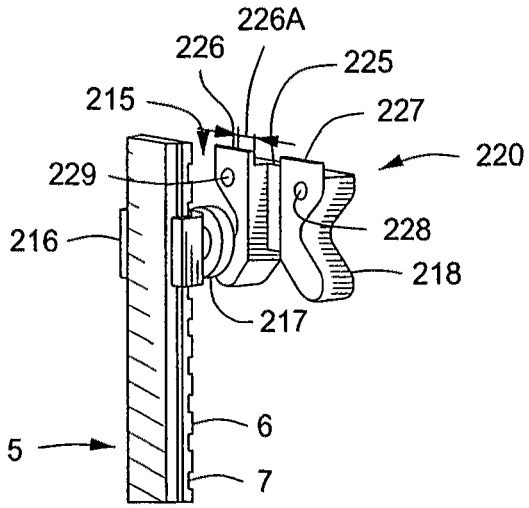
FIG. 4 is a bottom perspective view of the WeaponLink™ apparatus of FIG. 3.

In the embodiment shown in FIG. 2, the WeaponLink™ apparatus 110 may include a clip device with one or more spring tensioning members. The apparatus 110, which is shown operatively connected to the rail section 5 in FIG. 2, may include a connecting portion 120 similar to the connecting portion 20 shown and described with respect to the embodiment of FIG. 1. Also similar to the embodiment shown in FIG. 1, one or more holes 117 through the generally U-shaped portion 120 may accommodate one or more fastening members 125. Hole(s) 117 and fastening member(s) 125 are similar to the hole(s) 17 and fastening member(s) 25 shown and described with respect to FIG. 2.

Operatively attachable to the generally U-shaped portion 120 of the apparatus 110 is a clip portion 115. The clip portion 115 may be biased towards the rail section 5 via tension force of one or more springs or other tensioning devices (not shown). The clip portion 115 may include one or more extensions 131 from its width which are extendable through one or more additional holes 130 through the generally U-shaped portion 120. The one or more extensions 131 preferably include an extension 131 from each side of the clip portion 115, and the one or more holes 130 preferably include a hole in each side of the "U" of the U-shaped portion 120, where each respective extension 131 from each respective side extends through the hole 130 on its respective side.

The biasing force of the clip portion 115 may provide tension while the clip portion 115 is clipped on or tucked into the object or material which may be the same as the object or material to which the clip portion 115 is clipped as described above with respect to the embodiment of FIG. 1.

The above-described connection devices may be further secured with additional connection members, e.g., hardware such as magnetic force, spring tensioning devices, or gravity locking.

FIGS. 3-6 illustrate a third embodiment of the WeaponLink™ apparatus 210 which includes a male interface 215 and a female interface 220. The male interface 215 includes a connecting member 216 which is similar to the connecting portions 20 and 120 shown and described with respect to the embodiments of FIGS. 1-2; however, the connecting member 216 is shown as a separate piece from the remainder of the apparatus 210. Of course, it is within the scope of alternate embodiments that the connecting member 216 may be integral with or molded to any or all of the other pieces of the connecting member 216. The male interface 215 is attachable to the rail 5, e.g., via the connecting member 216 and its U shape engaging the rail within the "U."

Figure 5:
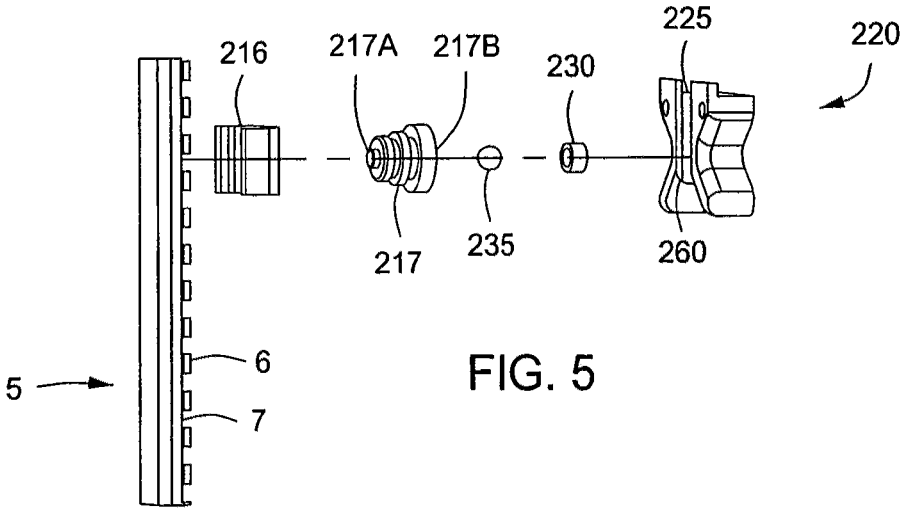
FIG. 5 is an exploded view of the WeaponLink™ apparatus of FIG. 3.
Figure 6:
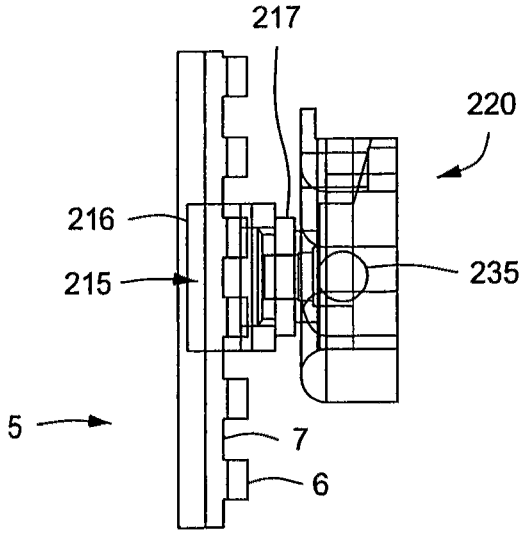
FIG. 6 is an assembled side view of the WeaponLink™ apparatus of FIG. 3.

As best illustrated in FIG. 5, the connecting member 216 and a connector 217 are operatively connected to one another, e.g.; via threaded connection. In one embodiment, the connecting member 216 includes female threads therethrough which mate with male threads on the connector 217; however, any method or means of connection between the connecting member 216 and connector 217 which are known to those skilled in the art may be employed for use with embodiments.

Upon its placement on the rail 5, the U-shape with tabs of the connecting member 216 grabs the rail 5 (and is therefore sized in its width to fit the intended rail on which it will be utilized) along its horizontal axis, while the threaded male cylinder of the, connector 217 places tension along the vertical axis by its insertion in the rail slot or cutout 7 (connector threaded mail cylinder is placed in between ridges or raised portions 6, which hold the cylinder in place vertically). In the embodiment shown, connector 217 is round at its first end 217A; however, the shape may be any shape capable of being retained within the slot 7 of the rail 5, including but not limited to dovetail, square, or any other shape capable of accommodating generally positive fixture stability depending on shape design and possible customer or user requirements.

A ball 235 may be placed in the second end 217B of the connector 217, and a retaining member 230 for the ball 235, such as a flange or nut, may be placed over the ball 235. The ball 235 and retaining member 230 may be molded or otherwise attached at or near the second end 217B of the connector 217. The ball 235 may instead be of any other shape known to those skilled in the art which is capable of forming an extension or protrusion from the male interface 215 for retention of the male interface 215 within the female interface 220 (see below).

The female interface 220 may include a receptacle 225 or channel or slot, which may be a cutout in the female interface 220. The receptacle 225 may be formed through a first side of the female interface 220 and terminate at a second side 218 of the female interface 220. Thus, the receptacle 225 is bounded by a first piece 226 of the first side, a second piece 227 of the first side, and a second side 218 of the female interface 220. The receptacle 225 is sized to allow at least a portion of the male interface 215 to slide along the receptacle 225 into an eventual friction fit with the female interface 220 via the boundaries of the receptacle 225 (see FIG. 6). To this end, shoulders 226A (shoulder of second piece 227 is not shown) from the first piece 226 and second piece 227 jut inward into the receptacle 225 to retain the male interface 215 within the receptacle when the male interface 215 is placed therein.

Optionally, an indention may be formed within the receptacle-facing portion of the second side 218 to permit secure retention and locking of the male and female interfaces 215, 220 to one another once the ball 235 reaches and enters the indention. The indention may be shaped to fit and retain the ball 235 therein.

One or more holes 228 and 229 may be formed through the female interface 220 for attaching the female interface 220 to one or more surfaces or mounting plates, for example via one or more screws, bolts, or other fastening members (not shown). In the embodiment shown in FIGS. 3-6, the female interface 220 is shaped similar to an "X" on its bottom half; however, any shape of the female interface is within the scope of embodiments, and embodiments are not limited to the shape depicted in the figures.

Figure 10:
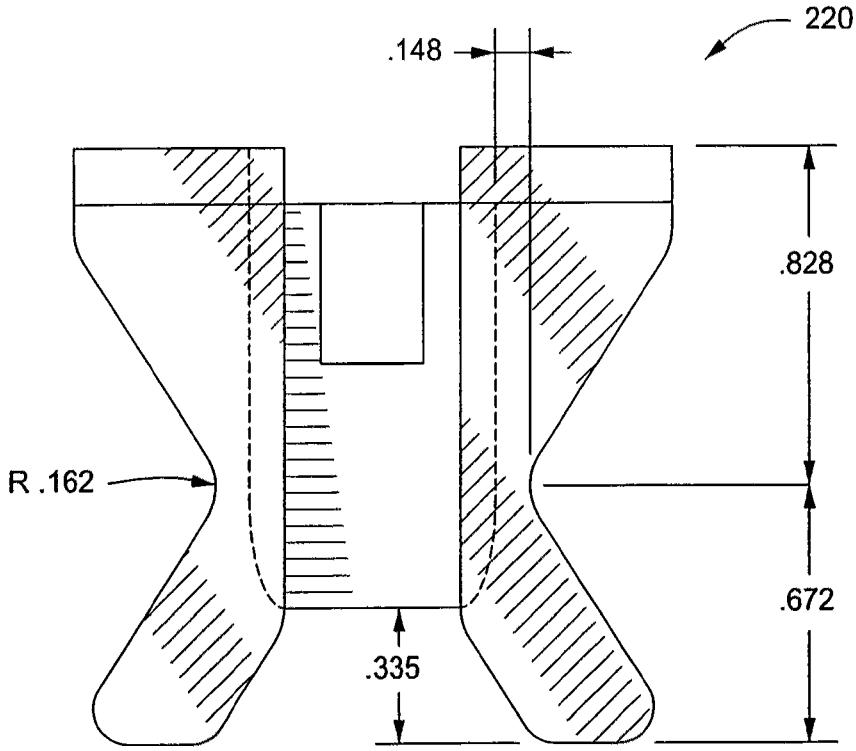
FIG. 10 is a downward view of the female member of the WeaponLink™ apparatus of FIG. 3.

FIG. 10 illustrates some exemplary dimensions (in approximate inches) of the female interface 220 shown and described with respect to FIGS. 3-6.

Figure 7A:
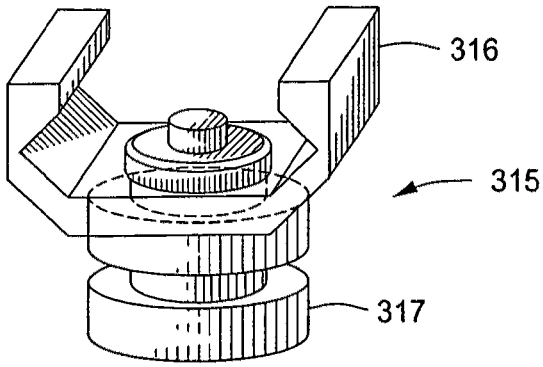
FIG. 7A is a perspective view of a male member of a fourth embodiment of a WeaponLink™ apparatus.
Figure 7B:
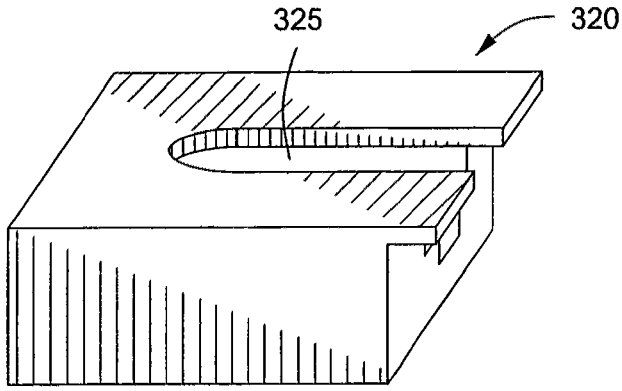
FIG. 7B is a perspective view of a female member of a fourth embodiment of a WeaponLink™ apparatus.

FIGS. 7A and 7B illustrate a fourth embodiment. FIG. 7A shows a male interface 315 which is the same as or similar to the male interface 215 shown and described with respect to FIGS. 3-6. The male interface 315 is capable of receiving a rail 5 or other accessories within the generally U-shaped portion of its connecting member 316. Its connector 317 is shaped to slide through a receptacle 325 of the female interface 320, which is shown in FIG. 7B. The female interface 320 of FIG. 7B is shown as generally rectangular-shaped, which is one of its possible shapes (but as mentioned above, any shape of the female interface 320 is contemplated as within the scope of embodiments).

Figure 9:
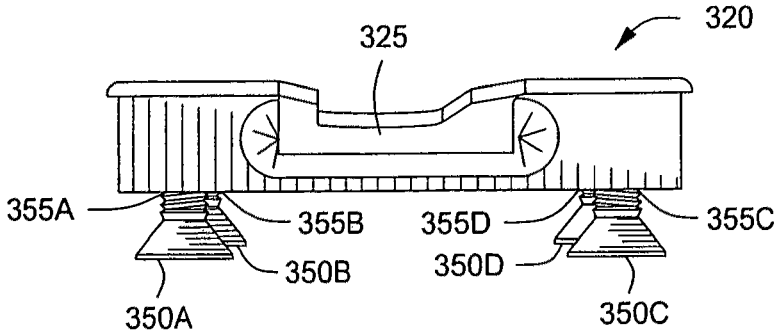
FIG. 9 is a side view of the female member of FIG. 7B.

FIG. 9 shows a front end view of the female interface 320 of FIG. 7B with fastening members 350A, 350B, 350C, and 350D within their respective holes 355A, 355B, 355C, and 355D through the female interface 320. The fastening members 350A, 350B, 350C, and 350D may be utilized to connect the female interface 320 to one or more surfaces or mounting plates. Of course, any number of holes and fastening members may be utilized for this purpose, including only one hole and fastening member, and the holes may be formed through any location on the female interface 320.

Figure 8:
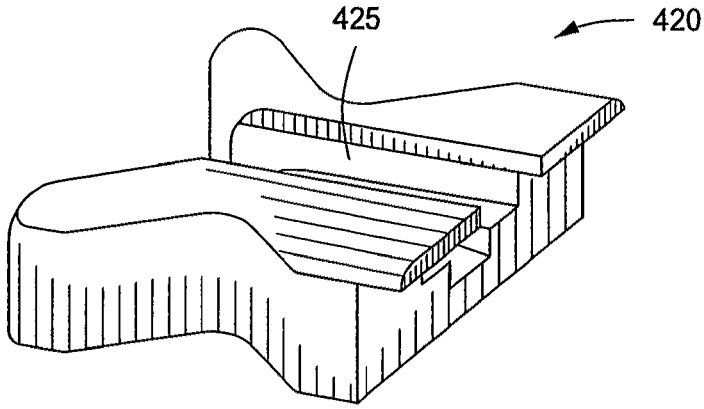
FIG. 8 is a perspective view of a female member of a fifth embodiment of a WeaponLink™ apparatus.

FIG. 8 illustrates an embodiment of the female interface 420 in another shape, with the receptacle 425 running therethrough. This female interface 420 may cooperate with the male interface 315, with the male interface 315 being connectable to the rail 5 or other accessory.

In an embodiment, the WeaponLink™ apparatus of FIGS. 3-9 may grab a rail (e.g., a standard M1913 rail system) along its horizontal axis and place tension along the vertical axis with a threaded male cylinder. In some embodiments, the WeaponLink™ apparatus rail mount may be secured to the rail system using existing through-holes with one or more fasteners (e.g., threaded fasteners), rivets, nuts, bolts, cam-type devices, and/or spring-loaded balls or plunger-type devices which may be constructed from, for example, plastic and/or metal such as stainless steel, aluminum, and/or forge-hardened steel, or any other material or fastener or connector known to those skilled in the art which is capable of securing objects to one another. This same threaded male cylinder may be responsible for providing the protrusion shape that will connect and lock into the female interface, which may be accomplished with the existing shape alone, or further tension to lock the male and female interfaces to one another may be provided by one or more magnet devices, spring-loaded balls, and/or plunger-type devices, or any other mechanisms known to those skilled in the art capable of connecting the interfaces to one another.

The female interface of embodiments provides a receptacle shaped to receive at least a portion of the male interface. The receptacle may be in the form of a pocket, groove, slot, notch, and/or slide, or any other type of receptacle capable of fitting a portion of the male interface therein to provide a connection between the two interfaces, and optionally further tension between the male and female interfaces may be applied using one or more magnets, spring-loaded balls, and/or plunger-type devices, or any other mechanisms known to those skilled in the art capable of connecting the interfaces to one another. In one embodiment, the female interface is designed to receive a variety of mounting plates which provide for mounting along various surfaces (e.g., MOLLE system, standard belt, wall surface, vehicle door, security locker, etc.).

In the embodiments described above, the WeaponLink™ apparatus is capable of connecting one or more accessories to one or more locations, surfaces, objects, and/or materials. The one or more accessories may for example include one or more of the following: rail, firearm (e.g., rifle or assault rifle), tool (e.g., mechanical tool), quick detach pouch. The one or more locations, surfaces, objects, and/or materials may for example include one or more of the following: mounting plate, tactical equipment, other equipment piece, belt, vehicle (e.g., a vehicle door), vest, location on a MOLLE system (e.g., of a standard military tactical nylon vest), pocket, along the waist line, wall surface, security locker. The one or more accessories may be attached to the connecting portion 20, 120 or male interface 215, 315, while the one or more locations, surfaces, objects, and/or materials may be attached to the clip portion 15, 115 or female interface 220, 320, 420. The male and female interfaces are then removably attachable to one another to attach the one or more accessories to the one or more locations, surfaces, objects, and/or materials via the male and female interfaces, while the connecting portion and clip portion may be removably attachable to one another or instead may be molded together to attach the one or more accessories to the one or more locations, surfaces, objects, and/or materials via the connecting portion and clip portion.

Figure 13:
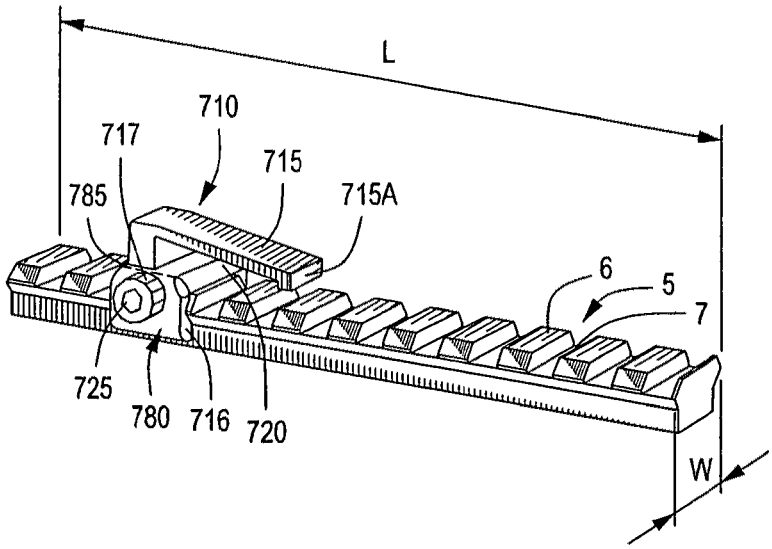
FIG. 13 is a perspective view of a sixth embodiment of a WeaponLink™ apparatus operatively connected to a rail section.

A sixth embodiment of a WeaponLink™ apparatus 710 is depicted in FIG. 13. In this embodiment, the WeaponLink™ apparatus 710 is a clip device. The WeaponLink™ apparatus 710 is shown attached to the rail system section 5 described with respect to the WeaponLink™ apparatus 10 of FIG. 1. A connecting portion 720 of the WeaponLink™ apparatus 710 may be shaped to removably connect to the rail section 5, for example generally U-shaped with inward protrusions 716 located at the ends of the "U" to hook around the rail section 5.

The apparatus 710 also includes a clip portion 715 which is either molded to or operatively connected to the connecting portion 720. The clip portion 715 may be a clip-like protrusion which extends longitudinally with respect to the U-shaped portion 720. The clip portion 715 is preferably made of a material which stays in the position shown in FIG. 1 until sufficient force to move the clip portion 715 relative to the U-shaped portion 720 is exerted by a material or object inserted between the clip portion 715 and the U-shaped portion 720. In other words, the clip portion 715 is biased toward the U-shaped portion 720 (biased closed) until a material or object overcomes that bias force to move the clip portion 715 away from the U-shaped portion 720. The material or object may be, for example, one or more locations along the MOLLE (modular lightweight load-carrying equipment) system of a standard military tactical vest (e.g., nylon vest), a belt (e.g., along the waistline), a pocket (either attached or unattached to clothing), a sling, or other tactical equipment. In one embodiment, the material or object is a sling (or other piece of tactical equipment for use in coupling a firearm to the user's body), and the sling (or other coupling tactical equipment) is the material or object inserted between the clip portion 715 and U-shaped portion 720 to result in an additional attachment point of the sling (or other coupling tactical equipment) to a weapon. The clip portion 715 may include a hook or an extension 715A which extends from an end of the clip portion 715 opposite the connection of the clip portion 715 to the connecting portion 720 to retain or hook the tactical equipment, object, or material in the apparatus 710 when it is clipped within the clip portion 715. Ultimately, the clip portion 715 and its hook extension 715A may form a hooking member for hooking the object, material, or tactical equipment (e.g., sling) therein. The clip portion 715 may optionally be shaped downward toward the connecting portion 720 as shown in FIG. 13 and a portion of the clip portion 715 may optionally extend past the connecting portion 720 with respect to the rail's length.

The connecting portion 720 may include one piece or may instead include two pieces, including a first connecting member 780 and a second connecting member 785. The two-piece version including the first connecting member 780 and the second connecting member 785 is shown as the dotted line in FIG. 13. In other embodiments, the entire connecting portion 720 is one piece molded together (without the dotted line).

In the two-piece version of the connecting portion 720 where it includes the first and second connecting members 780, 785, the first connecting member 780 includes a first side of the "U" and a first portion of the bottom of the "U" and the second connecting member 785 includes a second side of the "U" and a second portion of the bottom of the "U". The first and second portions of the bottom of the "U" cooperate with one another upon placement in contact with one another (as shown in FIG. 13) to form the entire bottom of the "U" of the U-shaped portion 720. In the one-piece version of the connecting portion 720, the entire U-shape is one piece.

The generally U-shaped portion 720 of the apparatus 710 may include inward protrusions 716 on each bottom side (which is the top of the "U") which secure the apparatus 710 around the rail section 5. The distance between inner surfaces of the inward protrusions 716 may be less than the distance between inner surfaces of a portion of the U-shaped portion 720 to allow clasping "grabbing" of the apparatus 710 onto the rail section 5 while at the same time permitting movement of the apparatus 710 along the length L of the rail section 5. The distance between inner surfaces of the protrusions 716 may be less than a width W of the rail section 5.

One or more holes 717 through the portion 720 may accommodate one or more fastening members 725, e.g., one or more screws, bolts, and/or nuts, etc. The one or more fastening members 725 may positionally secure the apparatus 710 to the rail section 5 at a location along the length L of the rail section 5. For example, screwing or inserting the fastening member(s) 725 into the hole(s) 717 may lock the apparatus 710 to the rail section 5 at a position along the length L of the rail section 5 and unscrewing or removing the fastening member(s) 725 from the hole(s) 717 may unlock the apparatus 710 from the rail section 5 to allow movement of the apparatus 710 relative to the rail section 5 lengthwise or longitudinally. The one or more fastening members 725 may include one or more threaded fasteners, rivets, nuts, bolts, cam-type devices, and/or spring loaded balls or plunger-type devices. The one or more fastening members 725 may be made from plastic (e.g., for light duty applications), stainless steel, aluminum, and/or forge-hardened steel. Of course, any other type of fastening member known to those skilled in the art made of any material known to those skilled in the art for constructing fastening members may be utilized in combination with or in lieu of the above-listed examples.

Additionally, in the embodiment of the two-piece connecting portion 720, the fastening member(s) performs the dual function of securing the apparatus 710 to the rail section 5 and connecting the first connecting member 780 and second connecting member 785 to one another to form the completed U-shaped connecting portion 720. When the connecting portion 720 is formed from two connecting members, the first connecting member 780 includes a hole 717 therethrough as shown in FIG. 13 and the second connecting member 785 may include a corresponding hole (not shown) through at least an inside portion of the "U" of the second connecting member 785 so that when the hole 717 through the first connecting member 780 and the hole through at least a portion of the second connecting member 785 are generally aligned with one another and generally aligned with a space 7 in a rail section 5 and the fastening member 725 is placed through both holes and through the space 7, the U-shape of the connecting portion 720 is formed and the apparatus 710 is positionally secured on the rail section 5.

Figure 14:
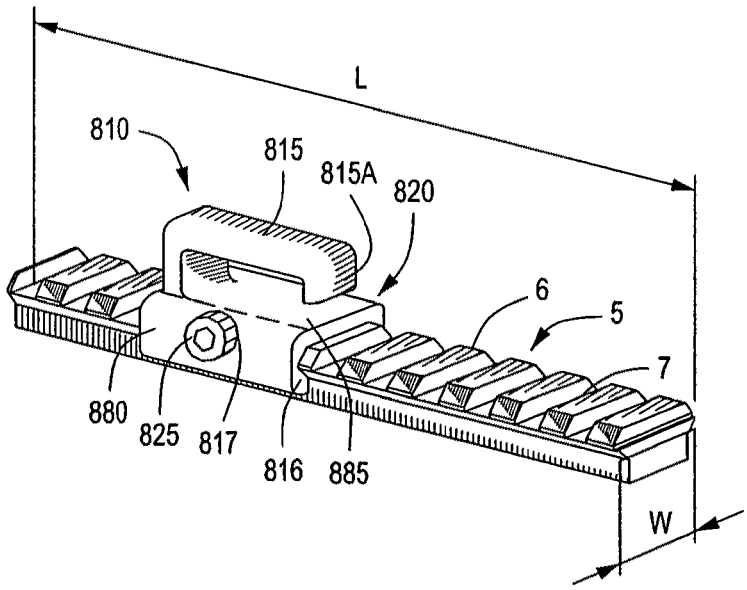
FIG. 14 is a perspective view of a seventh embodiment of a WeaponLink™ apparatus operatively connected to a rail section.

A seventh embodiment of a WeaponLink™ apparatus 810 is shown in FIG. 14. The WeaponLink™ apparatus 810 is also a clip device in this embodiment. The structure and function of the apparatus 810 is very similar to the apparatus 710; therefore, similar parts of the apparatus 810 to the parts of the apparatus 710 are denoted by the same last two numerals but in the 800 series rather than the 700 series. A difference in the apparatus 810 of FIG. 14 from the apparatus 710 in FIG. 13 is that the connecting portion 820 is longer in length than the connecting portion 720. In the apparatus 810, the connecting portion 820 may extend to a length equal to or greater than a length of the clip portion 815. Additionally, the one or more fastening members 825 and their holes 817 may be generally centered along the length of the rail section 5 as shown in FIG. 14. The clip portion 815 of FIG. 14 may be configured differently than the clip portion 715 of FIG. 13; as shown in FIG. 13, the clip portion is generally biased (sloped) towards the rail section 5 in a resting position, while the clip portion 815 length is generally level and disposed parallel to the length of the connecting portion 820.

An eighth embodiment of a WeaponLink™ apparatus 910 is illustrated in FIGS. 15-19 and 21-25. The WeaponLink™ apparatus 910 is also a clip device in this embodiment. The structure and function of the apparatus 910 is very similar to the apparatus 710 and 810; therefore, similar parts of the apparatus 910 to the parts of the apparatus 710 and 810 are denoted by the same last two numerals but in the 900 series rather than the 700 or 800 series.

The connecting portion 920 may include one piece or may instead include two pieces, including a first connecting member 980 and a second connecting member 985. The two-piece version including the first connecting member 980 and the second connecting member 985 is shown in FIGS. 15-19. In other embodiments, the entire connecting portion 920 is one piece molded together.

Figure 15:
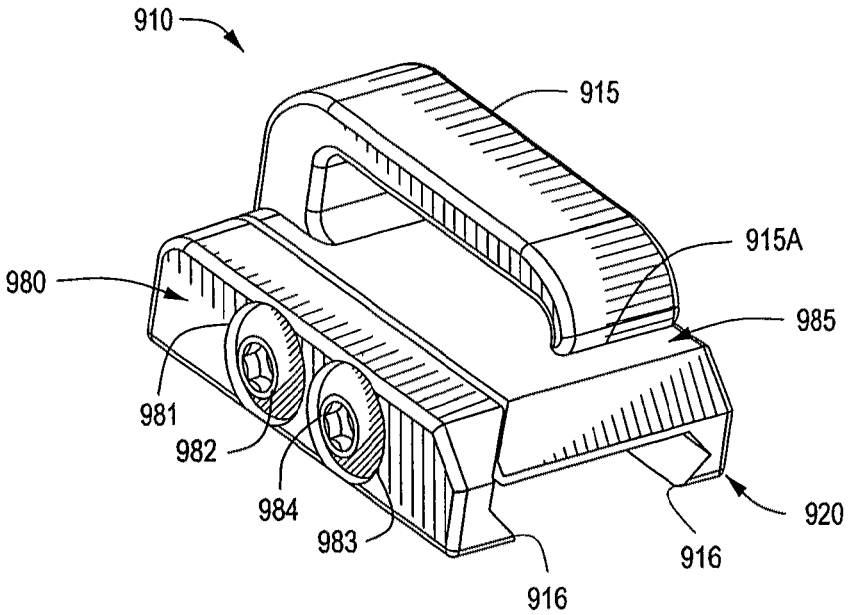
FIG. 15 is a perspective view of an eighth embodiment of a WeaponLink™ apparatus.
Figure 16:
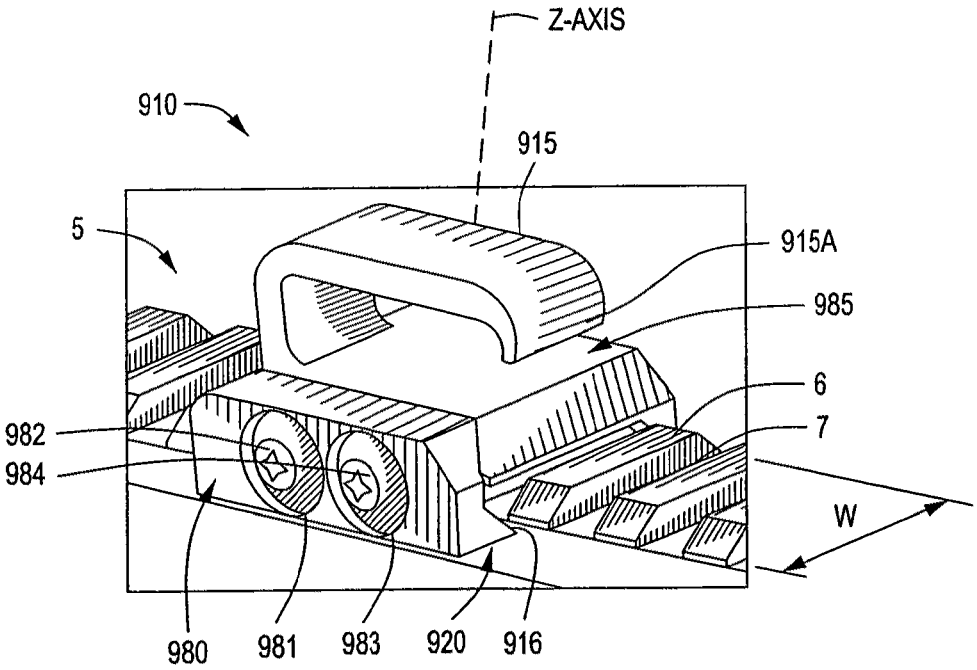
FIG. 16 is a perspective view of the WeaponLink™ apparatus of FIG. 15 operatively connected to a rail section.
Figure 18:
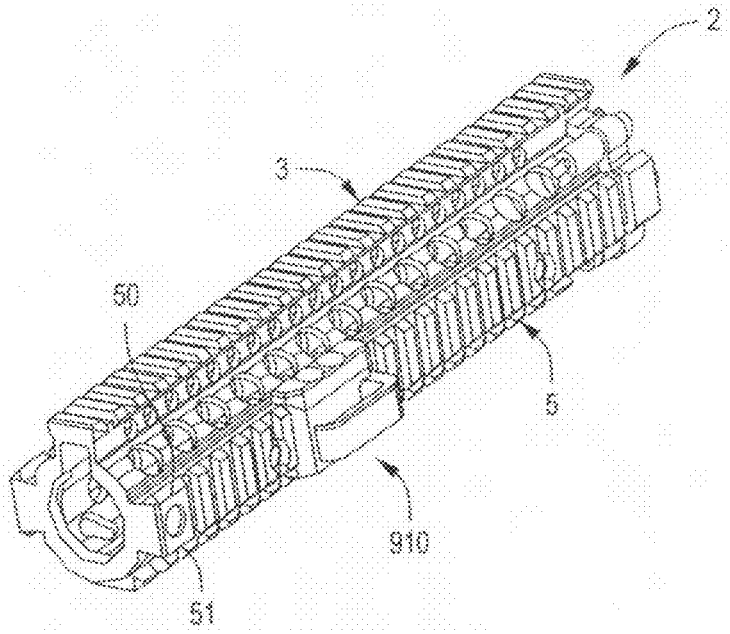
FIG. 18 is a perspective view of the WeaponLink™ apparatus of FIG. 15 operatively connected to a rail.

In the two-piece version of the connecting portion 920 where it includes the first and second connecting members 980, 985, the first connecting member 980 includes a first side of the "U" and a first portion of the bottom of the "U" and the second connecting member 985 includes a second side of the "U" and a second portion of the bottom of the "U". The first and second portions of the bottom of the "U" cooperate with one another upon placement in contact with one another (as shown in FIGS. 15, 16, and 18) to form the entire bottom of the "U" of the U-shaped portion 920. In the alternate embodiment one-piece version of the connecting portion 920, the entire U-shape is one piece.

The generally U-shaped portion 920 of the apparatus 910 may include inward protrusions 916 on each bottom side (which is the top of the "U") (in the two-piece connecting portion 920 embodiment, one protrusion extends from the first connecting member 980 and one protrusion extends from the second connecting member 985) which secure the apparatus 910 around the rail section 5 (similar to the protrusions 716 previously described). The distance between inner surfaces of the inward protrusions 916 may be less than the distance between inner surfaces of an end portion of the U-shaped portion 920 to allow clasping or "grabbing" of the apparatus 910 onto the rail section 5 while at the same time permitting movement of the apparatus 910 along the length L of the rail section 5. Additionally, the innermost surfaces of the protrusions 916 may be smaller than an outer width W of the rail section 5 to permit clasping or grabbing of the apparatus 910 onto the rail section 5.

Figure 17:
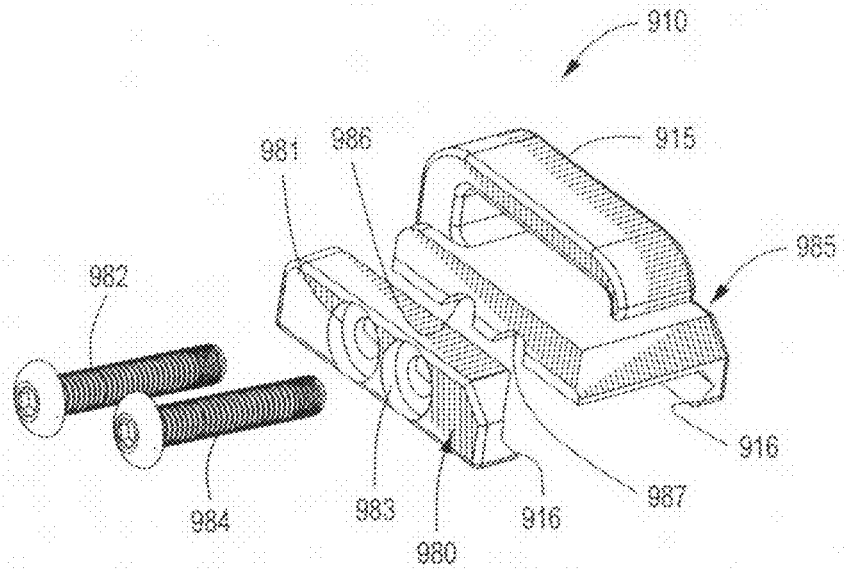
FIG. 17 is an exploded view of the WeaponLink™ apparatus of FIG. 15.
Figure 19:
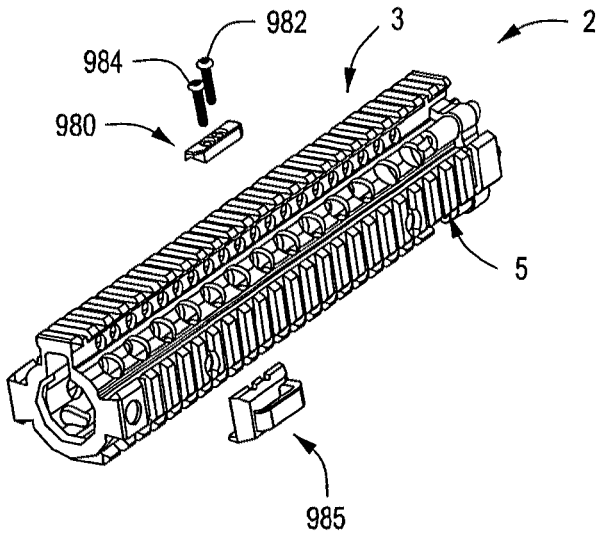
FIG. 19 is an exploded view of the WeaponLink™ apparatus of FIG. 15 detached from the rail of FIG. 18.
Figure 20:
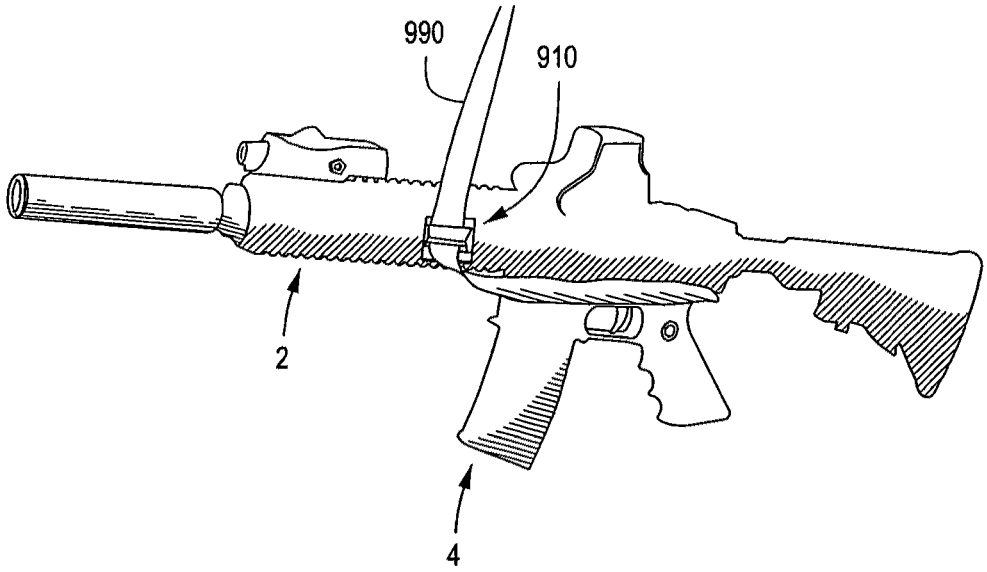
FIG. 20 is a view of the WeaponLink™ apparatus used with a sling system for a firearm.

One or more holes, in the shown embodiment a first hole 981 and a second hole 983, through the first connecting member 980, may accommodate one or more fastening members, in the shown embodiment a first fastening member 982 and a second fastening member 984, e.g., one or more screws, bolts, nuts, and/or any fastening member disclosed herein or known to those skilled in the art. The first fastening member 982 may be disposed in the first hole 981, and the second fastening member 984 may be disposed in the second hole 983, e.g., threaded through the holes. The second connecting member 985 may also include one or more holes through at least a portion thereof, as shown in FIG. 17 and FIG. 19 a first hole 986 through the second connecting member 985 and a second hole 987 through the second connecting member 985. To positionally secure the apparatus 910 on the rail 5 and assemble the apparatus 910, the first hole 981 through the first connecting member 980 is generally aligned with the first hole 986 through the second connecting member 985 and the fastening member 982 disposed through the first hole 981, the desired space 7 in the rail 5, and the first hole 986, and likewise the second hole 983 through the first connecting member 980 and the second hole 987 through the second connecting member 985 are generally aligned with one another and with the desired space 7 and the fastening member 984 disposed through the second hole 983, the desired space 7 in the rail 5, and the second hole 987.

The one or more fastening members 982, 984 through their respective holes 981, 983 and 986, 987 and spaces 7 may positionally secure the apparatus 910 to the rail section 5 at a location along the length L of the rail section 5. For example, screwing or inserting the fastening member(s) 982, 984 into the respective hole(s) 981, 983 and 986, 987 and spaces 7 may lock the apparatus 910 to the rail section 5 at a position along the length L of the rail section 5 and unscrewing or removing the fastening member(s) 982, 984 from the hole(s) 981, 983 and 986, 987 may unlock the apparatus 910 from the rail section 5 to allow movement of the apparatus 910 relative to the rail section 5 lengthwise or longitudinally. The one or more fastening members 982, 984 may include one or more threaded fasteners, rivets, nuts, bolts, cam-type devices, and/or spring loaded balls or plunger-type devices. The one or more fastening members 982, 984 may be made from plastic (e.g., for light duty applications), stainless steel, aluminum, and/or forge-hardened steel. Of course, any other type of fastening member known to those skilled in the art made of any material known to those skilled in the art for constructing fastening members may be utilized in combination with or in lieu of the above-listed examples.

In the embodiment of FIGS. 15-19, the first holes 981, 986 and second holes 983, 987 may be spaced from one another to permit the first fastening member 982 and the second fastening member 984 to extend through different spaces 7 in the rail 5. This staggering of the holes along the length of the connecting portion 920 adds stability to the apparatus 910 and the connection it makes. The two-piece connecting portion 920 advantageously allows easy removal from, installation of, and positioning of the entire apparatus 920 on the rail 5 without the need to slide the apparatus 910 along the rail section 910.

Additionally, in the embodiment of the two-piece connecting portion 920, the fastening member(s) performs the dual function of securing the apparatus 910 to the rail section 5 and connecting the first connecting member 980 and second connecting member 985 to one another to form the completed U-shaped connecting portion 920. When the connecting portion 920 is formed from two connecting members, the first connecting member 980 includes holes 981, 983 therethrough as shown in FIG. 17 and the second connecting member 985 includes corresponding holes 986, 987 through at least an inside portion of the "U" of the second connecting member 985 so that when the holes 981, 983 through the first connecting member 980 and the holes 986, 987 through at least a portion of the second connecting member 985 are generally aligned with one another and generally aligned with separate, spaced-apart spaces 7 in a rail section 5 and the fastening members 982, 984 are placed through their respective aligned holes and through the spaces 7, the U-shape of the connecting portion 920 is formed and the apparatus 910 is positionally secured on the rail section 5.

The clip portion 915 may include a hook or an extension 915A which extends from an end of the clip portion 915 opposite the connection of the clip portion 915 to the connecting portion 920 to retain or hook the tactical equipment, object, or material in the apparatus 910 when it is clipped within the clip portion 915. Ultimately, the clip portion 915 and its hook extension 915A may form a hooking member for hooking the object, material, or tactical equipment (e.g., sling) therein.

FIGS. 18 and 19 show the apparatus 910 with a rail 2 which may include multiple rail sections 5, 3 (the other two rail sections of this embodiment, which are disposed generally on opposite sides of the rail 2 shown in FIG. 18, are not shown in FIG. 18). In the rail 2 shown in FIGS. 18 and 19, the rail sections 5, 3 (others not shown) are disposed at a 12 o'clock position, a 3 o'clock position, a 6 o'clock position, and a 9 o'clock position around a central axis of the rail and may be disposed at like positions with respect to the central axis of a barrel of a firearm disposed through the rail 2, as is known to those skilled in the art.

FIG. 18 shows the apparatus 910 connected to a rail section 5 of the rail 2 at a location on the rail section 5. In the connected position of the apparatus 910 on the rail 2, the fastening members 982, 984 are disposed through spaces 7 of the rail section 5, and protrusions 916 extend around outer surfaces 50, 51 of the rail section 5. FIG. 19 shows the apparatus 910 disconnected from the rail section 5 and components of the apparatus 910 disconnected from one another.

FIGS. 20 and 22-25 illustrate use of the apparatus 910 to convert a single-point sling with only one connection from a firearm 4 to a sling 990 into a two-point sling where the firearm 4 is connected to the sling 990 at two separate points. Any tactical equipment which is used to ultimately connect a firearm to a user's body may be substituted for the sling 990 in embodiments.

Figure 21:
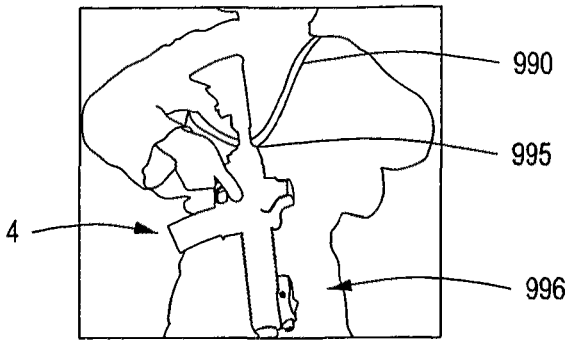
FIG. 21 is a front view of a user having a single-point sling system disposed on his or her body.

FIG. 21 illustrates the single point sling. In the previous single point sling configuration, the sling 990 which is hung onto the user's body 996 was attached at a single point 995 to the firearm 4. As described above, this single point sling configuration is hazardous, dangerous, and an inadequate means of weapon retention to a user's body. The single-point sling system disadvantageously results in the firearm hanging loosely off of the user's body and lacks ease of mobility or secure retention of the firearm to the body.

Figure 22:
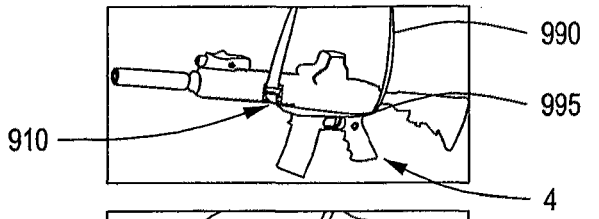
FIG. 22 is a side view of the WeaponLink™ apparatus of embodiments cooperating with the single point sling system for secure weapon retention.
Figure 23:
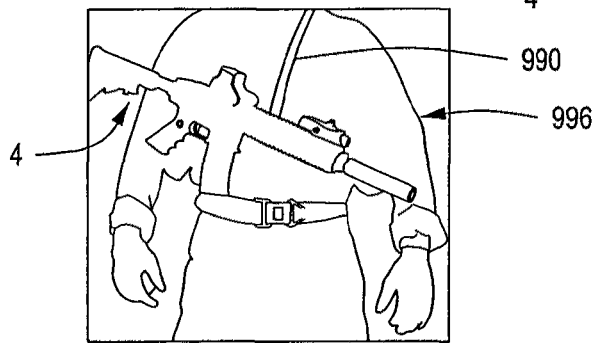
FIG. 23 is a front view of a user's body having the WeaponLink™ apparatus of embodiments cooperating with the single point sling system to hang a firearm from the front of a user's body for secure weapon retention.
Figure 24:
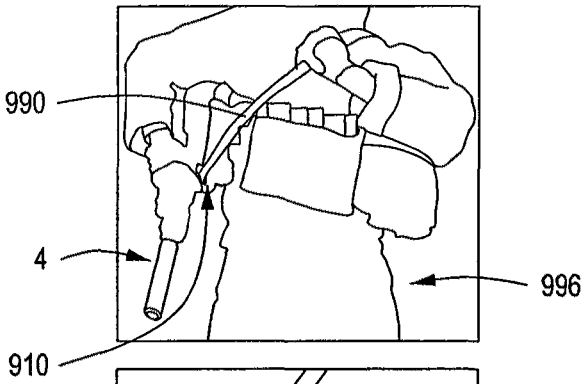
FIG. 24 is a front view of the user's body having the WeaponLink™ apparatus of embodiments cooperating with the single point sling system to hang a firearm from the side of the body.
Figure 25:
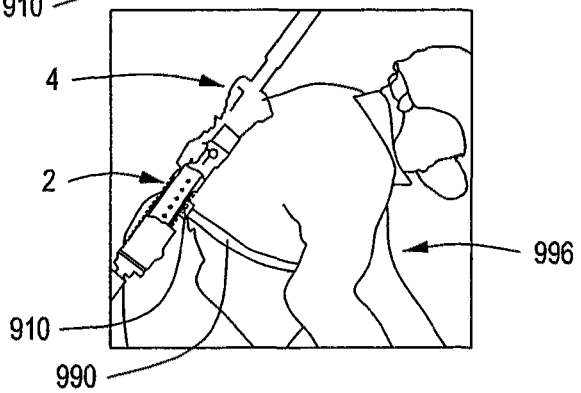
FIG. 25 is a side view of the back of the user's body having the WeaponLink™ apparatus of embodiments cooperating with the single point sling system to hang a firearm from the back of the body.

FIG. 22 shows a sling 990 having two connection points 995 and 910 to the firearm 4. The attachment point 995 is in the usual manner known by those skilled in the art of attaching the sling to a firearm, e.g., the same single point attachment point which would be used for a single point sling configuration as known by those of ordinary skill in the art. However, embodiments disclosed herein use the WeaponLink™ apparatus 910 as an additional attachment point of the sling 990 to the firearm 4. This two-point attachment configuration adds stability to the firearm with respect to a user's body when the sling is slung over the body, for example as shown in FIGS. 23-25. Ultimately, the apparatus 910 acts as a sling clip, and the sling clip works in conjunction with the single-point sling system for secure weapon retention and ease of mobility.

FIG. 23 shows the sling clip apparatus 910 working with the single point sling system to provide secure, close-body retention of the firearm 4 on the body 996. The two connection points of the sling 990 permit secure retention of the firearm 4 on the front of the body 996 when the sling is slung over the user's shoulder as shown.

FIG. 24 shows the sling clip apparatus 910 working with the single point sling system to provide secure, close-body retention of the firearm 4 on the body 996, as well as complete mobility for weapon access and retention. The two connection points of the sling 990 permit secure retention of the firearm 4 on the side of the user's body 996 as shown when the sling 990 is slung over the user's shoulder as shown.

FIG. 25 shows the sling clip apparatus 910 working with the single point sling system to provide secure, close-body retention of the firearm 4 on the body 996, as well as complete mobility for ease of weapon access and retention. The two connection points of the sling 990 permit secure retention of the firearm 4 on the back of the user's body 996 as shown when the sling 990 is slung over the user's shoulder as shown.

Although the WeaponLink™ apparatus 910 is shown in FIGS. 20 and 22-25, it is within the scope of embodiments that any other WeaponLink™ apparatus disclosed herein may be utilized in lieu of the WeaponLink™ apparatus 910 with the sling 990 to form a dual connection sling system. Additionally, although only two connection points are shown and described with respect to the sling system of FIGS. 20 and 22-25, it is within the scope of embodiments that any number of WeaponLink™ apparatus may be utilized as additional connection points of the sling to the firearm.

The WeaponLink™ apparatus 710, 810, and 910 as well as 10 and 110 may be a SlingClip™ clip device for use in connecting a sling to a firearm or other accessory. Therefore, the term "WeaponLink™ apparatus" for 710, 810, 910, 10, and 110 may optionally be substituted with the term SlingClip™ in this specification.

In operation; the WeaponLink™ apparatus 10 of FIG. 1 is secured to the rail 5 (or other accessory) by placing the accessory or rail 5 within the U-shape of the connecting portion 20 (thereby securing the WeaponLink™ apparatus 10 horizontally). The WeaponLink™ apparatus 10 is then secured vertically by the one or more fastening members 25, e.g., by inserting the one or more fastening members 25 through the holes 17 in the connecting portion 20. The one or more fastening members 25 may be inserted in one of the slots or cutouts 7. Thus, the fastening member 25 holds the apparatus 10 in position relative to the rail 5 because it is held in place by its boundaries of the bottom of the "U" of the fastening member 25 and the two raised portions 6 of the rail 5 beside the cutout 7, and the bottom of the "U" is positionally engaged by the inward extensions of the top of the "U" which at least partially wrap around the rail 5.

The rail 5 may be secured to a firearm. To secure the rail 5 to a location, surface, object, and/or material, the location, surface, object, and/or material is inserted between the clip portion 15 and the connecting portion 20. Therefore, the location, surface, object, and/or material is ultimately connected to the rail 5 and/or firearm via the apparatus 10.

To remove the location, surface, object, and/or material from the rail 5 or other accessory or firearm, the location, surface, object, and/or material may be removed from the clip portion 15. Additionally or instead, the connecting portion 20 may be removed from the rail 5 or other accessory or firearm.

In operation, the WeaponLink™ apparatus 110 of FIG. 2 is secured to the rail 5 (or other accessory) in the same way as the WeaponLink™ apparatus 10 of FIG. 1 is secured to the rail 5 (or other accessory), as described above. The location, surface, object, and/or material is ultimately connected to the rail 5 and/or firearm in the same way as described above with respect to the WeaponLink™ apparatus 10 of FIG. 1. In the embodiment of FIG. 2, the clip device 115 provides spring tensioning force on the location, surface, object, and/or material to maintain it within the apparatus 10. The location, surface, object, and/or material may be removed from the clip device 115 by counteracting the spring tension bias force.

In operation, the WeaponLink™ apparatus 210 of FIGS. 3-8 is secured to the rail 5 (or other accessory) by placing the accessory or rail 5 within the U-shape of the connecting member 216 of the male interface 215. The U-shape with tabs of the connecting member 216 grabs the rail 5 (and is therefore sized in its width to fit the intended rail on which it will be utilized) along its horizontal axis, thereby securing the apparatus 210 horizontally. The male connector 217, when placed in a hole through the bottom of the "U" (which is preferably sized to retain the mail connector 217 therein), rests within a cutout 7 of the rail 5 and may rest in between raised portions 6. Therefore, the connector 217 positionally maintains the male interface 215 vertically by its positioning between the raised portions 6 within the cutout 7.

The female interface 220 may be connected to a location, surface, object, and/or material, for example through a mounting plate (not shown) and/or through one or more fasteners disposed through holes 229. To connect the female interface 220 to the male interface 215, the male interface 215 is placed within the receptacle 225 of the female interface 220 at the open end of the receptacle 225. The male interface 215 then slides along the female interface 220 through the receptacle 225 until it abuts a shoulder 260 of the receptacle 225. The male and female interfaces 215, 220 may be temporarily locked relative to one another using the protrusion shape that will connect and lock into the female interface, which may be accomplished with the existing shape alone, or further tension to lock the male and female interfaces to one another may be provided by one or more magnet devices, spring-loaded balls, and/or plunger-type devices, or any other mechanisms known to those skilled in the art capable of connecting the interfaces to one another. Ultimately, the location, surface, object, and/or material is removably or releasably but securely connected to the one or more accessories via the apparatus 210.

To disconnect the male and female interfaces 215, 220 from one another, the male interface 215 slides along the receptacle 225 from the shoulder 260 in the direction of the open end of the receptacle 225 and slides through the open end of the receptacle 225.

The apparatus 210 may be easily removed from the rail 5, accessory, or firearm by removing male interface 215 therefrom, and/or the apparatus 210 may be easily removed from the location, surface, object, and/or material by disconnecting the location, surface, object, and/or material from the female interface 220 (e.g., by unscrewing or otherwise removing the one or more fastening members from the holes 229).

The other embodiments of the female interface 320, 420 as well as the other embodiment of the male interface 315 operate in the same way as described above with respect to the female interface 220 and male interface 215.

Figure 11:
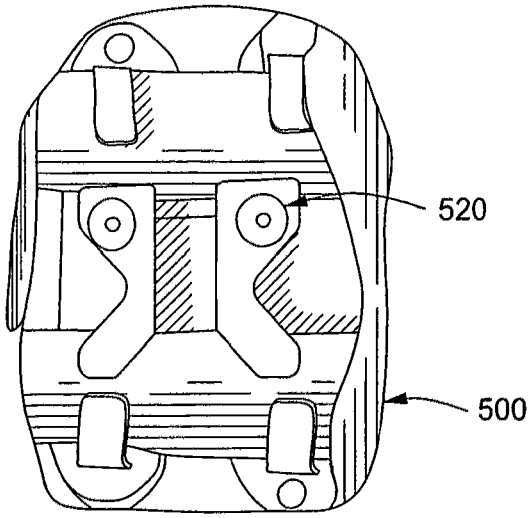
FIG. 11 is a view of a WeaponLink™ apparatus on a MOLLE system component.
Figure 12:
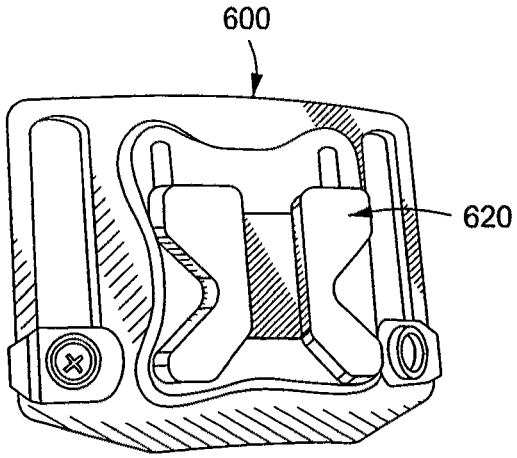
FIG. 12 is a view of a WeaponLink™ apparatus on a portion of a belt.

FIG. 11 shows an embodiment of a WeaponLink™ apparatus 520 on a MOLLE version 500, and FIG. 12 shows an embodiment of a WeaponLink™ apparatus 620 on a portion of a belt 600. The WeaponLink™ apparatus 520 or 620 may include any of the embodiments shown and described herein in relation to FIGS. 1-10 or may instead have shown variations to the embodiments shown and described herein.

In operation, the WeaponLink™ apparatus 710 or 810 of FIG. 13 or FIG. 14 is secured to the rail 5 (or firearm or other accessory) by placing the accessory, firearm, or rail 5 within the U-shape of the connecting portion 720 or 820 (thereby securing the WeaponLink™ apparatus 710 or 810 horizontally). In the two-piece version of the apparatus 710 or 810, the first and second connecting members 780, 785 or 880, 885 are placed around the rail 5 so that the rail 5 is located inside of the ultimately formed "U." The apparatus 710 or 810 is placed along the rail 5 so that the hole(s) 717 or 817 are aligned with the desired space(s) 7 in the rail section 5.

The WeaponLink™ apparatus 710 or 810 is then secured in all directions (x-axis, y-axis, and z-axis) with respect to the rail section 5 and the first and second connecting members 780, 785 or 880, 885 are secured together as well by the one or more fastening members 725 or 825, e.g., by inserting the one or more fastening members 725 or 825 through the hole (s) 717 or 817 in the connecting portion 720 or 820. The one or more fastening members 725 or 825 may be inserted in one of the slots or cutouts 7. Thus, the fastening member(s) 725 or 825 hold the apparatus 710 or 810 in position relative to the rail 5 because it is held in place by its boundaries of the bottom of the "U" of the fastening member 725 or 825 and the two raised portions 6 of the rail 5 beside the cutout 7, and the bottom of the "U" is positionally engaged by the inward extensions of the top of the "U" which at least partially wrap around the rail 5.

The rail 5 may be secured to a firearm. To secure the rail 5 to a location, surface, object, and/or material, the location, surface, object, and/or material is inserted between the clip portion 715 or 815/hooking member and the connecting portion 720 or 820 and thereby clipped or hooked to the rail 5. Therefore, the location, surface, object, and/or material is ultimately connected to the rail 5 and/or firearm via the apparatus 710 or 810. The location, object, surface, and/or material may be a sling or other tactical equipment for securing the firearm to a person's body.

To remove the location, surface, object, and/or material from the rail 5 or other accessory or firearm, the location, surface, object, and/or material may be removed from the clip portion 715 or 815/hooking member. Additionally or instead, the connecting portion 720 or 820 may be removed from the rail 5 or other accessory or firearm or repositioned on the rail 5. Repositioning or removal of the connecting portion 720 or 820 on/from the rail 5 or other accessory or firearm may be completed by removing the fastening member(s) 717 or 817 from the space(s) 7 in the rail 5, sliding the connecting portion 720 or 820 along the rail section 5 and repositioning and reconnecting the apparatus 710 or 810 to the rail 5 at another space 7 on the rail section 5, or instead removing the connecting portion 720 or 820 from the rail section 5 and optionally reconnecting it to another rail section or another accessory or firearm as described above.

In the situation where the apparatus 710 or 810 includes the two connecting members 780, 785 or 880, 885, removal of the apparatus 710 or 810 from the rail section 5 may be accomplished by removing the fastening member(s) 717 or 817 from the space(s) 7 in the rail 5 and disconnecting the two connecting members 780, 785 or 880, 885 from one another so that the protrusions 716, 816 no longer retain the connecting members 780, 785 or 880, 885 on the rail 5. The apparatus 710 or 810 may be repositioned on another rail section at another space 7 and reassembled and reconnected as described above, or instead it may be reassembled and reconnected to another rail section or accessory or firearm as described above.

In operation, the WeaponLink™ apparatus 910 of FIGS. 15-19 is secured to the rail 5 (or other accessory or firearm) by placing the accessory or rail 5 within the U-shape of the connecting portion 920 (thereby securing the WeaponLink™ apparatus 910 horizontally with respect to the rail's width W and also with respect to the rail's z-axis). To place the rail 5 (or firearm or accessory) within the U-shape of the connecting portion 920, the first and second connecting members 980 and 985 are placed around the rail 5 so that the rail 5 is located inside of the ultimately formed "U" and so that the protrusions 916 are disposed beneath/around the rail section 5. The apparatus 910 is placed along the rail 5 so that the holes 981 and 983 are aligned with the desired spaces 7 in the rail section 5.

The WeaponLink™ apparatus 910 is then secured in all directions (x-axis, y-axis, and z-axis) with respect to the rail section 5 and the first and second connecting members 980 and 985 are secured together as well by the fastening members 982 and 984, e.g., by inserting the first fastening member 982 through the hole 981, through the cutout 986, and through an aligned space 7 through the rail 5 and inserting the second fastening member 984 through the hole 983 in the connecting portion 920, through the cutout 987, and through a different aligned space 7 through the rail 5. Each of the fastening members 982, 984 may be inserted in a different slot or cutout 7 to increase stability of the connection between the apparatus 910 and the rail section 5. Thus, the fastening members 982 and 984 hold the apparatus 910 in position relative to the rail 5 because it is held in place by its boundaries of the bottom of the "U" of the fastening members 982 and 984 and the two raised portions 6 of the rail 5 beside each cutout 7, and the bottom of the "U" is positionally engaged by the inward extensions of the top of the "U" which at least partially wrap around the rail 5.

The rail 5 may be secured to a firearm. To secure the rail 5 to a location, surface, object, and/or material, the location, surface, object, and/or material is inserted between the clip portion 915/hooking member and the connecting portion 920 and thereby clipped or hooked to the rail 5. Therefore, the location, surface, object, and/or material is ultimately connected to the rail 5 and/or firearm via the apparatus 910. The location, object, surface, and/or material may be a sling or other tactical equipment for securing the firearm to a person's body, such as the sling 990 depicted in FIGS. 22-25.

To remove the location, surface, object, and/or material from the rail 5 or other accessory or firearm, the location, surface, object, and/or material may be removed from the clip portion 915/hooking member. Additionally or instead, the connecting portion 920 may be removed from the rail 5 or other accessory or firearm or repositioned on the rail 5. Repositioning or removal of the connecting portion 920 on/from the rail 5 or other accessory or firearm may be completed by removing the fastening members 982 and 984 from their respective spaces 7 in the rail 5, sliding the connecting portion 920 along the rail section 5 and repositioning and reconnecting the apparatus 910 to the rail 5 at other spaces 7 on the rail section 5, or instead removing the connecting portion 920 from the rail section 5 and optionally reconnecting it to another rail section or another accessory or firearm or to a different rail system 2 (see FIG. 18) in the same manner of connection as described above.

Removal of the apparatus 910 from the rail section 5 or rail system 3 may be accomplished by removing the fastening members 982 and 984 from their respective spaces 7 in the rail 5 or rail system 3 and from their respective cutouts 986 and 987 in the second connecting member 985, thereby disconnecting the two connecting members 980 and 985 from one another so that the protrusions 916 no longer retain the connecting members 980 and 985 on the rail section 5 or rail system 3. The apparatus 910 may be repositioned on another rail section at other spaces 7 and reassembled and reconnected as described above, or instead it may be reassembled and reconnected to another rail section or accessory or firearm as described above.

The operation of a Weaponlink™ apparatus as a sling clip is shown in FIGS. 20 and 22-25. Any of the embodiments of the WeaponLink™ apparatus described above, including embodiments which are not clips, may be used as a second connection point for a sling to a firearm rail, firearm, or other accessory. In the embodiment shown in FIG. 22, the WeaponLink™ apparatus 910 is shown; however, any of the WeaponLink™ apparatus described herein may be substituted for the WeaponLink™ apparatus 910 in FIGS. 20 and 22-25 and in the following description. The ordinary single point attachment of the sling 990 is shown at attachment point 995. To add stability to the firearm's attachment to a user's body 996, the WeaponLink™ apparatus 910 adds a second attachment point spaced apart from the first attachment point 995. In some embodiments, the second attachment point is located at a position on the rail section 5 or rail 3, and the rail 3 or rail section 5 is attached to the firearm 4. The various attachment positions and body placement positions of the sling 990 and its stability in those positions are shown in FIGS. 23-25.

Ultimately, in the embodiment shown in FIGS. 22-25, the WeaponLink™ apparatus acts as a point of connection between the rail 3 or rail section 5 and the sling 990 which is easily attachable, removable, and re-attachable to different positions on the rail 3 and rail section 5, and the sling is easily connectible, removable, repositionable to the WeaponLink™ apparatus.

Embodiments may provide weapon retention during hands free operations. In some embodiments, the WeaponLink™ apparatus is a clip-like device, ruggedized for military/law enforcement use.

In embodiments disclosed herein which are used with a single point sling, the WeaponLink™ apparatus may create a temporary secondary attachment point for the single point sling which tightens the sling to the user's body. The WeaponLink™ apparatus, in some examples the SlingClip™, acts as a fulcrum or additional bend point in the flat woven strapping. By moving the SlingClip™ further away from the sling's own single point attachment fastener, the sling becomes tighter around the user's upper torso. When the user routes the sling webbing material into the SlingClip™, it creates more tension and draws the rifle into a snug fit to the user's upper torso, which creates a much greater level of weapon retention than available in the prior art attachment methods and devices.

Hooking action of the SlingClip™ may also be used to hang/hook the rifle or other firearm onto a temporary receiving piece (e.g., belt, pants pocket, tactical vest). This hooking method uses the weight of the rifle or other firearm as a downward force on the hook of the SlingClip™ and the receiving material. This hooking method may be used as a quick and temporary weapon retention method.

The WeaponLink™ apparatus may be, in some embodiments, a low profile device fitted on M1913 Picatinny Rail System or other rail system known to those skilled in the art.

In some embodiments, a method of using the WeaponLink™ apparatus may include hooking the WeaponLink™ apparatus over a strap used to retain a firearm on a user's body and using the hook's tension/surface friction to retain its own position along the hooked position of the strapping material.

Embodiments may include a rail grabber (which may be made of metal or plastic material, or any other material known to those skilled in the art which is capable of performing the purposes of the rail grabber as described herein) with a hook-type feature that receives and tensions webbing material (the webbing material may be equally sized), and an opening that is wide enough to receive the webbing thickness and narrow enough to maintain surface tension along the webbing surface when webbing material is slightly twisted or bent over/around the sling clip hook.

A benefit of embodiments of the SlingClip™ is that they may be added to already-manufactured rail systems and tactical equipment.

While the foregoing is directed to embodiments of the present invention, other and further embodiments of the invention may be devised without departing from the basic scope thereof, and the scope thereof is determined by the claims that follow.

The invention claimed is:

1. An apparatus for connecting a firearm to tactical equipment, comprising:

a grabbing portion capable of positionally fixing the apparatus with respect to a width of the firearm or a rail section attachable to the firearm or another object;

a connector capable of positionally fixing the apparatus with respect to a length of the firearm or a rail section attachable to the firearm or another object; and a clipping portion capable of clipping the tactical equipment to the firearm, rail section, or another object, wherein the grabbing portion comprises at least two pieces including a first piece and a second piece, the first piece capable of grabbing one side of the firearm or a rail section attachable to the firearm or another object and the second piece capable of grabbing another side of the firearm or a rail section attachable to the firearm or another object, the clipping portion attached to the second piece.

2. The apparatus of claim 1, wherein the first piece comprises a first hole therethrough and wherein the connector is disposed through the first hole and through a first cutout portion of the firearm or the rail section attachable to the firearm or another object to fix the apparatus vertically to the firearm or the rail section attachable to the firearm or another object and to connect the first and second pieces to one another.

3. The apparatus of claim 2, wherein the first piece further comprises a second hole therethrough spaced apart from the first hole, the central axis of the first hole generally parallel to the central axis through the second hole.

4. The apparatus of claim 3, wherein a second connector is disposed through the second hole and through a second cutout portion of the firearm or the rail section attachable to the firearm or another object, the second cutout portion of the firearm or the rail section attachable to the firearm or another object spaced apart from the first cutout portion and generally parallel to the first cutout portion.

5. The apparatus of claim 2, wherein the clipping portion is a hook and the grabbing portion is a rail grabber.

6. The apparatus of claim 1, wherein the tactical equipment is used for securing the firearm or other accessory to a user's body.

7. The apparatus of claim 6, wherein the tactical equipment is a sling and wherein the apparatus provides a second attachment point of the sling to the firearm.

8. The apparatus of claim 1, wherein the clipping portion is biased closed onto the grabbing portion.

9. The apparatus of claim 8, wherein a tension from bias force of the clipping portion and surface tension is capable of positionally retaining the tactical equipment within the clipping portion.

10. The apparatus of claim 1, wherein the first piece comprises a first hole therethrough and wherein the connector is disposed through at least a portion of the first hole of the first piece and through a first cutout portion of the firearm or the rail section attachable to the firearm or another object to positionally fix the apparatus to the firearm or the rail section attachable to the firearm or another object.

11. The apparatus of claim 1, wherein the clipping portion is spring biased closed onto the grabbing portion.

12. An apparatus for connecting a firearm to tactical equipment, comprising:

a rail grabber having a hooking member for receiving and tensioning a strapping member, the hooking member having an opening which is wide enough to receive a thickness of the strapping member and narrow enough to maintain surface tension along the strapping member surface, the rail grabber for grabbing a rail connectable to a firearm and positionally maintaining the apparatus with respect to the rail.

13. The apparatus of claim 12, wherein the rail grabber comprises:

a first connecting member having a first hole therethrough;

a second connecting member; and a first fastening member, the rail grabber connectable to the rail by inserting the first fastening member through the first hole and through a space between adjacent protrusions in the rail when the first and second connecting members are placed in contact with one another.

14. The apparatus of claim 13, wherein the hooking member maintains surface tension along the strapping member surface at a first location, and wherein the strapping member is attached to the rail or the firearm at a second location spaced apart from the first location.

15. The apparatus of claim 12, wherein the strapping member is webbing material, and the opening in the hooking member maintains surface tension along the webbing material when the webbing material is twisted or bent around the hooking member.

16. An apparatus for connecting a firearm to tactical equipment, comprising:

a grabbing portion capable of positionally fixing the apparatus with respect to a width of a rail or a rail section, the rail or the rail section attachable to the firearm or to another object;

a connector capable of positionally fixing the apparatus with respect to a length of the rail or the rail section; and a clipping portion capable of clipping the tactical equipment to the rail or the rail section, wherein the grabbing portion comprises at least two pieces including a first piece and a second piece, the first piece capable of grabbing one side of the rail or the rail section and the second piece capable of grabbing another side of the rail or the rail section, the clipping portion attached to the second piece.

17. The apparatus of claim 16, wherein the first piece comprises a first hole therethrough and wherein the connector is disposed through at least a portion of the first hole of the first piece and through a first cutout portion of the rail or the rail section to positionally fix the apparatus to the rail or the rail section.

18. The apparatus of claim 17, wherein the second piece comprises a first hole therethrough and wherein the connector is disposed through at least a portion of the first hole of the second piece to connect the first and second pieces to one another.

19. The apparatus of claim 16, wherein the clipping portion is biased closed with respect to the grabbing portion.

20. The apparatus of claim 19, wherein a tension from bias force of the clipping portion and surface tension is capable of positionally retaining the tactical equipment within the clipping portion.

* * * * *